US010213929B2

(12) United States Patent
Lau

(10) Patent No.: US 10,213,929 B2
(45) Date of Patent: Feb. 26, 2019

(54) VIBRISSA AND EYEBROW SCISSORS HAVING FIXED BLADE AND MOVEABLE BLADE CAPABLE OF BEING RINSED SEPARATELY

(71) Applicant: SPECIALIFE (ZHUHAI) CO., LTD., Zhuhai, Guangdong (CN)

(72) Inventor: Tung Yan Lau, Guangdong (CN)

(73) Assignee: SPECIALIFE (ZHUHAI) CO., LTD., Zhuhai (CN)

( * ) Notice: Subject to any disclaimer, the term of this patent is extended or adjusted under 35 U.S.C. 154(b) by 0 days.

(21) Appl. No.: 15/638,391

(22) Filed: Jun. 30, 2017

(65) Prior Publication Data

US 2018/0029242 A1 Feb. 1, 2018

(30) Foreign Application Priority Data

Jul. 27, 2016 (CN) ..... 2016 1 0601337

(51) Int. Cl.
*B26B 19/06* (2006.01)
*B26B 19/38* (2006.01)
*B26B 19/14* (2006.01)

(52) U.S. Cl.
CPC ..... *B26B 19/06* (2013.01); *B26B 19/148* (2013.01); *B26B 19/38* (2013.01); *B26B 19/3846* (2013.01); *B26B 19/063* (2013.01)

(58) Field of Classification Search
CPC ... Y10T 29/49; B26B 19/148; B26B 19/3846; B26B 19/063; B26B 19/38
USPC ..... 29/592; 30/195, 29.5, 216, 223, 61, 60, 30/43.92, 43.91, 43, 217–220
See application file for complete search history.

(56) References Cited

U.S. PATENT DOCUMENTS 1,642,532 A * 9/1927 Beauregard ..... B26B 19/066 30/197
3,319,334 A * 5/1967 Bond ..... B26B 19/04 30/34.1
3,708,879 A * 1/1973 Stephenson ..... B26B 21/32 30/60
4,651,761 A * 3/1987 Suen ..... B26B 19/20 132/148
2011/0010942 A1* 1/2011 Lau ..... B26B 19/06 30/29.5
2014/0041233 A1* 2/2014 Lau ..... B26B 19/148 30/29.5

* cited by examiner

*Primary Examiner* — Ghassem Alie

(57) ABSTRACT

The disclosure provides a pair of vibrissa and eyebrow scissors having a fixed blade and a moveable blade capable of being rinsed separately. The pair of vibrissa and eyebrow scissors comprises a scissors head and a scissors body, wherein a driving device is arranged in the scissors body. The scissors head further comprises a blade separation device; the blade separation device is connected with the fixed blade or the moveable blade; and by operating the blade separation device, the fixed blade and the moveable blade that are in a laminating state are separated from each other. On the basis of the traditional vibrissa and eyebrow scissors, the disclosure is provided with a blade separation device which may separate the moveable blade from the fixed blade, so that the rinsing effect can be enhanced.

8 Claims, 6 Drawing Sheets

VIBRISSA AND EYEBROW SCISSORS HAVING FIXED BLADE AND MOVEABLE BLADE CAPABLE OF BEING RINSED SEPARATELY

CROSS-REFERENCE TO PRIOR APPLICATION

This application claims the benefit of Chinese Patent Application No. 201610601337.7 filed on Jul. 27, 2016, the contents of which are incorporated herein by reference.

TECHNICAL FIELD

The disclosure relates to the technical field of personal care products, and in particular to a pair of vibrissa and eyebrow scissors having a fixed blade and a moveable blade capable of being rinsed separately.

BACKGROUND

Traditional electric hair trimmers have a serious problem that they are easily stuck with secretions or accumulated with dirt when trimming hairs; even though the secretion or dirt is rinsed in time, residues are inevitable due to the fine and compact structure of the hair trimmer; after a long time of accumulation, not only sanitation problem appears and disgusting smell comes out, but also cutters are highly likely to be blocked and thus lose the hair cutting function, especially in cold or dry weathers; or, due to low battery or insufficient driving force, an electric machine cannot start a moveable blade stuck to a fixed blade, causing the moveable blade unable to make a reciprocating motion relative to the fixed blade to realize cutting. This problem troubles designers for a long time and must be overcome.

SUMMARY

In order to solve the defect and shortage in existing technologies, the purpose of the disclosure is to provide a new type pair of vibrissa and eyebrow scissors, which on one hand may enhance the rinsing effect and prevent secretions or dirt being stuck between cutters, and on the other hand may avoid the fixed blade and the moveable blade being stuck together to cause the electric machine unable to start.

The purpose of the disclosure is realized through the following technical scheme.

A pair of vibrissa and eyebrow scissors having a fixed blade and a moveable blade capable of being rinsed separately, including a scissors head and a scissors body, wherein a driving device is arranged in the scissors body, the scissors head includes a rear end part to be connected with the scissors body and a thin-long end part acting as a cutting part, the thin-long end part includes a moveable blade and a fixed blade that are arranged in a laminating manner, cutter teeth are formed at one side edge of the fixed blade and at one side edge of the moveable cutter, or are arranged at the two opposite side edges of the fixed blade and the moveable blade, and the moveable blade is driven by the driving device to make a back and forth translation type reciprocating motion relative to the fixed blade to realize the effect of cutting; the pair of vibrissa and eyebrow scissors is characterized in that: the scissors head further includes a blade separation device, which is connected with the fixed blade or the moveable blade, and, by operating the blade separation device, the fixed blade and the moveable blade that are in a laminating state are separated from each other.

The blade separation device has one way that the moveable blade keeps still and the fixed blade is pried outwards so that the fixed blade is separated from the moveable blade.

The pair of vibrissa and eyebrow scissors includes a blade pressing sheet, which is arranged on the back surface of the moveable blade and is used to tightly press the moveable blade towards the fixed blade on the back surface of the moveable blade; the blade separation device has such as an elasticity that the amplitude of the fixed blade pried up by the blade separation device not only can offset the height of the moveable blade bounced up by the blade pressing sheet arranged on the back surface of the moveable blade inside the scissors head when the fixed blade no longer presses the moveable blade, but also can make the end part of the fixed blade separated from the moveable blade bounced up by the blade pressing sheet.

Under this premise, the disclosure has the following embodiments:

One embodiment is: the blade separation device includes a fixed blade carrier acting as a fixed blade fixing device and an elastic element, the fixed blade carrier and the fixed blade are in rigid connection or are integrally molded, the elastic element is arranged between the bottom part of one end of the fixed blade carrier far away from the fixed blade and a shell body, preferably, the elastic element is embedded into the shell body of the scissors head, and, by pressing downwards the end part of the fixed blade carrier far away from the fixed blade, the fixed blade is pried away from the moveable blade.

In the above embodiment, preferably, the shell body of the scissors head includes an upper shell and a bottom shell, and the fixed blade carrier is embedded into the upper shell.

In the above embodiment, preferably, the elastic element is a spring, the upper shell of the scissors head is provided with a groove, one end of the spring abuts against the bottom part of one end of the fixed blade carrier far away from the fixed blade, while the other end abuts against the bottom part of the groove.

The blade separation device has another way that the fixed blade keeps still and the moveable blade is pressed downwards so that the moveable blade is separated from the fixed blade.

The shell body of the scissors head includes an upper shell and a bottom shell.

In an embodiment, the blade separation device is arranged at a position inside the scissors head shell body capable of pressing downwards the rear end part of the moveable blade, and the blade separation device is exposed to the surface of the upper shell of the scissors head, so that the moveable blade may be pressed towards the direction far away from the fixed blade by pressing the blade separation device, thereby making the moveable blade separated from the fixed blade.

Preferably, the scissors head includes a moveable blade assembly, the moveable blade assembly includes a moveable blade carrier and a moveable blade, the moveable blade is mounted on one end of the moveable blade carrier, the other end of the moveable blade carrier is connected with the driving device, the blade separation device is arranged between a position on the moveable blade carrier near the tail end of the moveable blade and the upper shell of the scissors head; when not pressed, the blade separation device is suspended relative to the moveable blade carrier; when pressed, the blade separation device contacts the surface of the moveable blade carrier and presses the moveable blade carrier together with the moveable blade towards the scissors head internal direction far away from the fixed blade so as to make the moveable blade separated from the fixed blade.

In order to realize rinsing after the moveable blade is separated from the fixed blade, the bottom shell of the scissors head is provided with a through hole, and the through hole is communicated with the bottom surface of the moveable blade or moveable blade carrier, that is, one surface away from the fixed blade, to make water passed through.

Compared with existing technologies, the disclosure has advantages as follows: on the basis of the traditional vibrissa and eyebrow scissors, a blade separation device is provided which may separate the moveable blade from the fixed blade, so that on one hand the rinsing effect can be enhanced and snot or secretions is or are prevented from being stuck between the fixed blade and the moveable blade, and on the other hand the moveable blade may be avoided being stuck to the fixed blade to cause the electric machine unable to start. This breakthrough scheme only needs to make an appropriate modification to the original vibrissa trimmer, without impacting the traditional usage method, and the blade separation rinsing structure is simple in design and easy in usage, with practicability and feasibility.

DESCRIPTION OF THE EMBODIMENTS

The disclosure provides a pair of vibrissa and eyebrow scissors having a fixed blade and a moveable blade capable of being rinsed separately, including a scissors head and a scissors body, wherein a driving device is arranged in the scissors body, the scissors head includes a rear end part to be connected with the scissors body and a thin-long end part acting as a cutting part, the thin-long end part includes a moveable blade and a fixed blade that are arranged in a laminating manner, cutter teeth are formed at one side edge of the fixed blade and at one side edge of the moveable cutter, or are arranged at the two opposite side edges of the fixed blade and the moveable blade, and the moveable blade is driven by the driving device to make a back and forth translation type reciprocating motion relative to the fixed blade to realize the effect of cutting; the scissors head further includes a blade separation device, which is connected with the fixed blade or the moveable blade, and, by operating the blade separation device, the fixed blade and the moveable blade that are in a laminating state are separated from each other. The scissors head is provided with a shell, and the shell is composed of an upper shell and a bottom shell.

Embodiment 1

Figure 1:
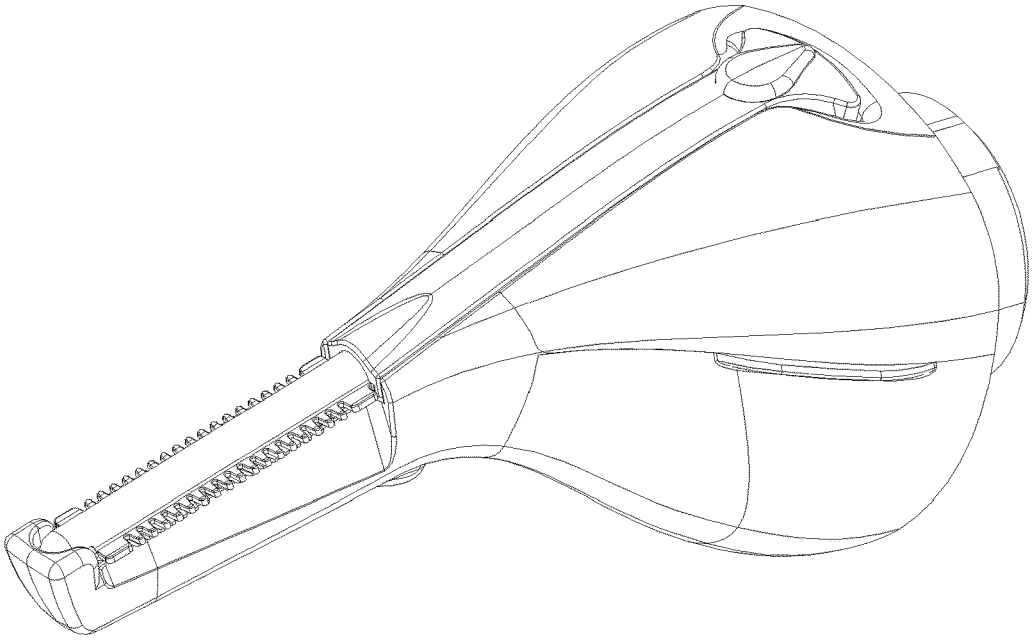
FIG. 1 and FIG. 2 are overall structure diagrams of a pair of vibrissa and eyebrow scissors having a fixed blade and a moveable blade unseparated and separated respectively in an Embodiment 1 of the disclosure respectively.
Figure 2:
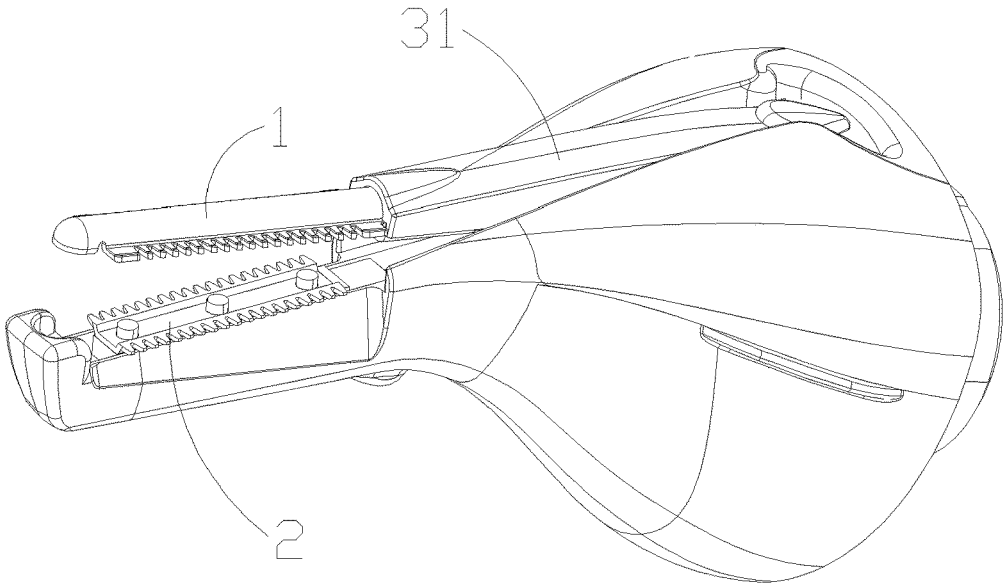
Figure 3:
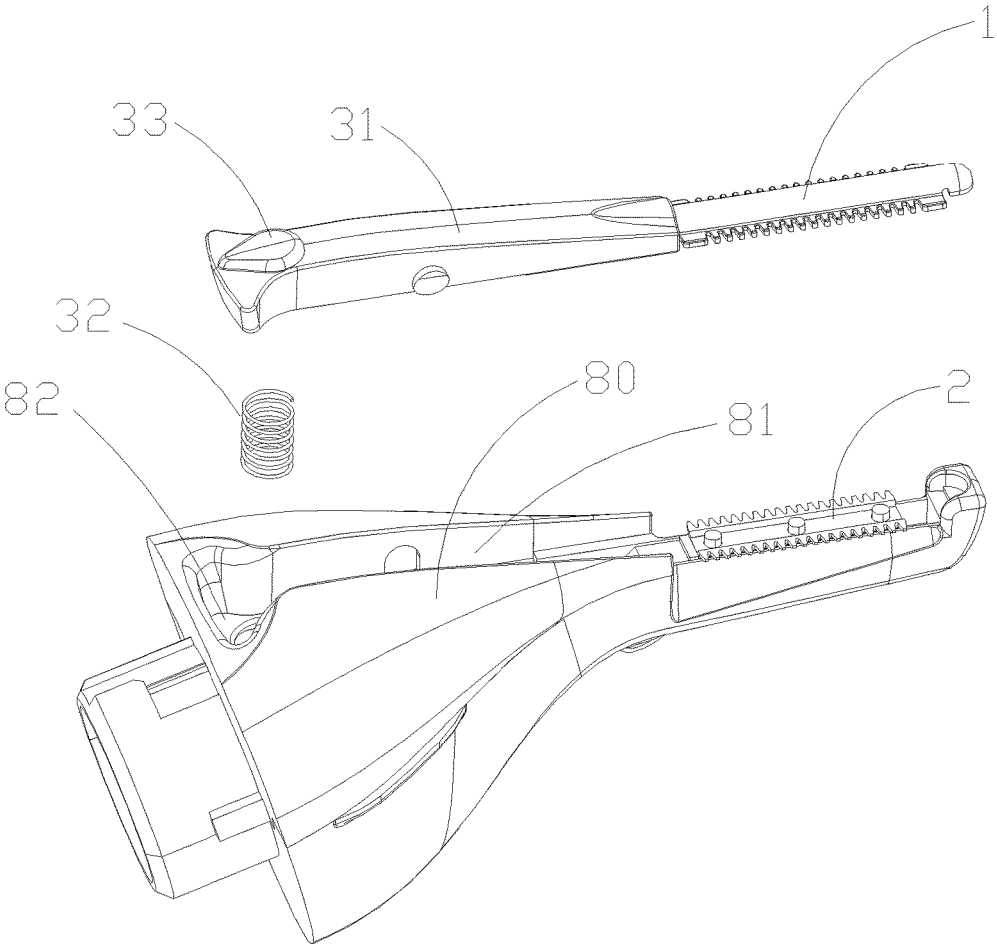
FIG. 3 and FIG. 4 are breakdown structure diagrams of a scissors head of the pair of vibrissa and eyebrow scissors in the Embodiment 1 of the disclosure.
Figure 4:
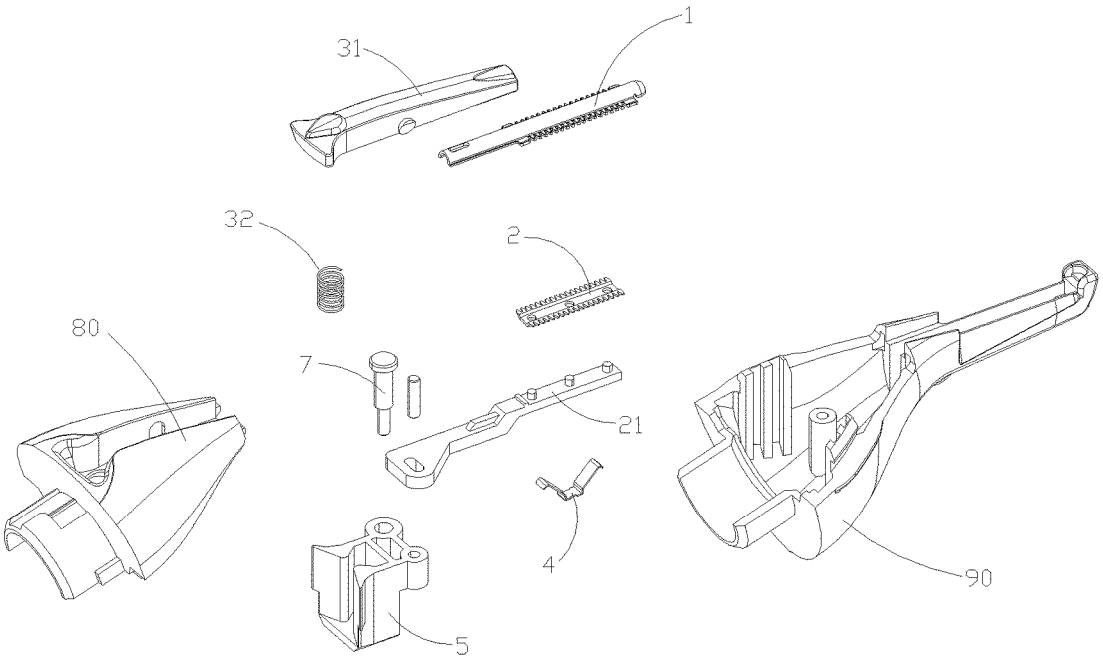

In this embodiment, as shown in FIG. 1 to FIG. 4, the blade separation device includes a fixed blade carrier 31 and a spring 32.

The fixed blade carrier 31 is in a long strip shape, one end of the fixed blade carrier 31 is in fixed connection with the rear end part of the fixed blade 1 and they two form a thin-long structure; the other end of the fixed blade carrier 31 is provided with a press part 33 capable of being pressed downwards. The spring 32 is arranged between the bottom part of the press part 33 and the upper shell 80. Specifically, the upper shell 80 (the upper shell 80 together with the bottom shell 90 forms the shell of the scissors head) is provided with a thin-long slot 81 which corresponds to the thin-long structure formed by the fixed blade 1 and the fixed blade carrier 31 and is provided with a deep notch 82 for accommodating the spring 32, the thin-long structure formed by the fixed blade 1 and the fixed blade carrier 31 is embedded into the thin-long slot 81, one end of the spring 32 abuts against the bottom part of the press part 33 while the other end abuts against the bottom part of the notch 82.

When the press part 33 is pressed downwards, the spring 32 is compressed, and one end of the fixed blade carrier 31 connected with the fixed blade 1 is tilted up, making the fixed blade 1 tilted up as well and then separated from the moveable blade 2.

It should be noted that the pair of vibrissa and eyebrow scissors in this embodiment further includes a blade pressing sheet 4, the moveable blade 2 is arranged on one end of a moveable blade carrier 21, the other end of the moveable blade carrier 21 is connected with the driving device (swing frame 5), the blade pressing sheet 4 is arranged on the back surface of the moveable blade carrier 21 and is used to tightly press the moveable blade 2 towards the fixed blade 1 on the back surface of the moveable blade 2, avoiding the fixed blade 1 and the moveable blade 2 being laminated untight to cause hair to be gripped. When the moveable blade 2 and the fixed blade 1 are not separated from each other, the blade pressing sheet 4 is in a pressed tight state, the fixed blade 1 is fixed, the blade pressing sheet 4 and the fixed blade 1 clamp the moveable blade 2 tightly. In the drawings, a pin 7 plays the role of connecting and fixing.

When the fixed blade 1 is pried away from the moveable blade, the fixed blade 1 loses the pressing force onto the front surface of the moveable blade 2, the blade pressing sheet 4 will be released and rebounded, making the moveable blade 2 tilted up along the direction that the fixed blade 1 is titled up; therefore, the elasticity of the spring 21 is required to be greater than the elasticity of the blade pressing sheet 4, so that, when the fixed blade 1 is separated from the moveable blade 2, the amplitude of the fixed blade 1 pried up is far greater than the amplitude of the moveable blade 2 bounced up by the blade pressing sheet 4, thereby authentically realizing separation between the fixed blade 1 and the moveable blade 2.

The fixed blade carrier also may be integrally molded with the fixed blade.

Embodiment 2

Figure 5:
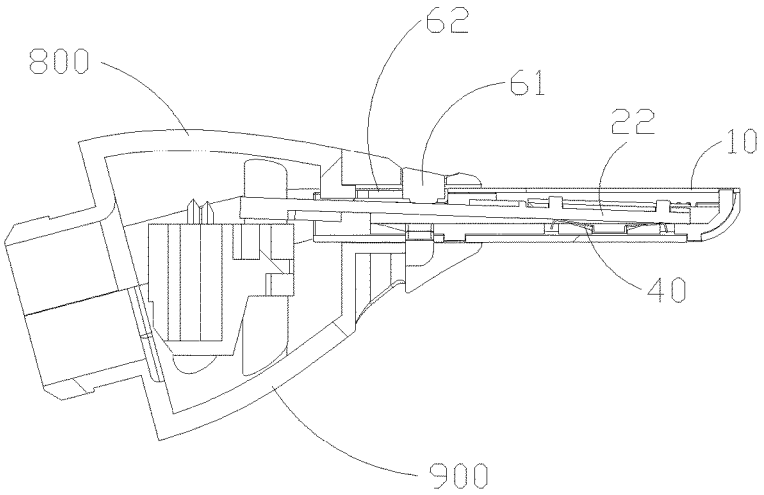
FIG. 5 is a section view of an Embodiment 2 of the disclosure.
Figure 6:
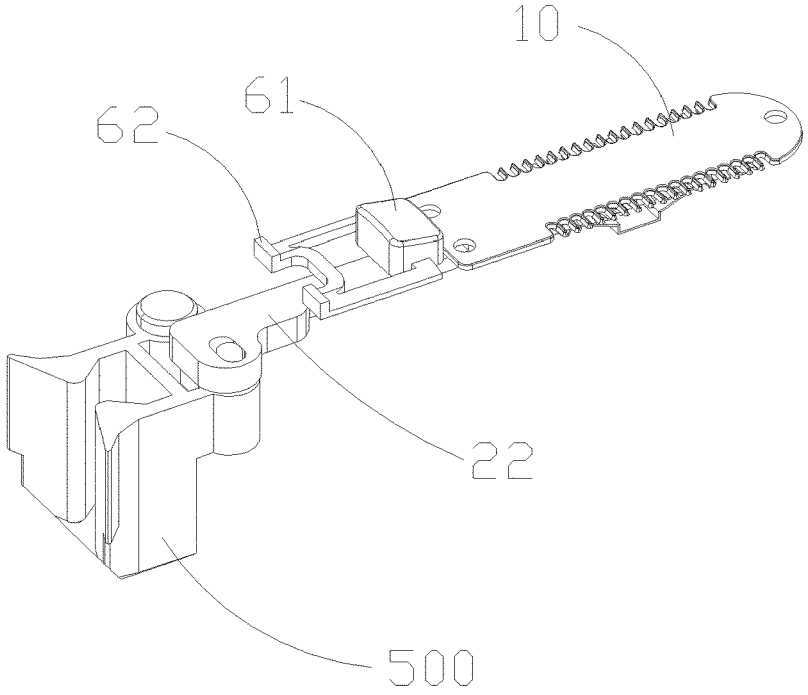
FIG. 6 is a structure diagram of a power part and relevant parts thereof in the Embodiment 2.
Figure 7:
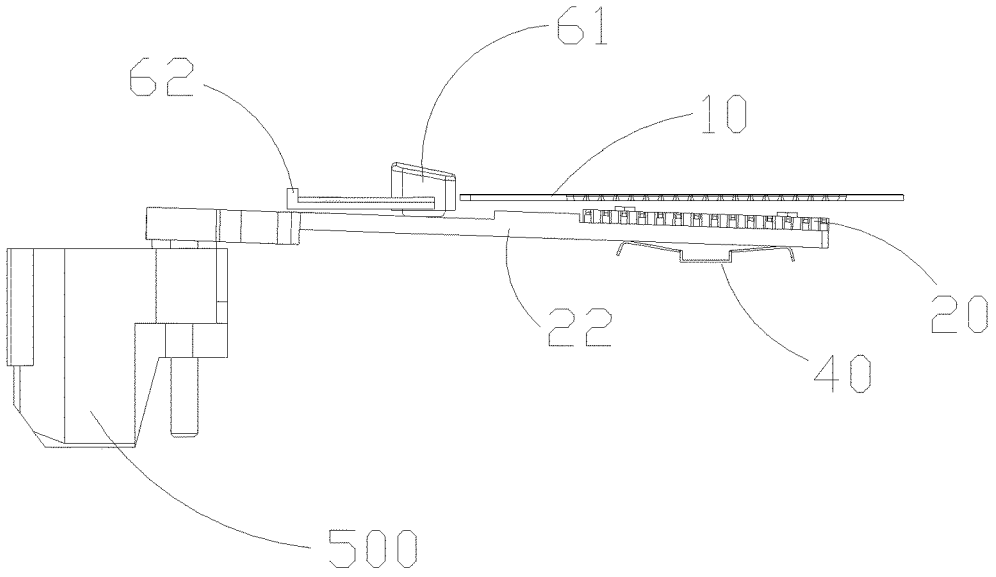
FIG. 7 is a working principle diagram of the part shown in FIG. 6.
Figure 8:
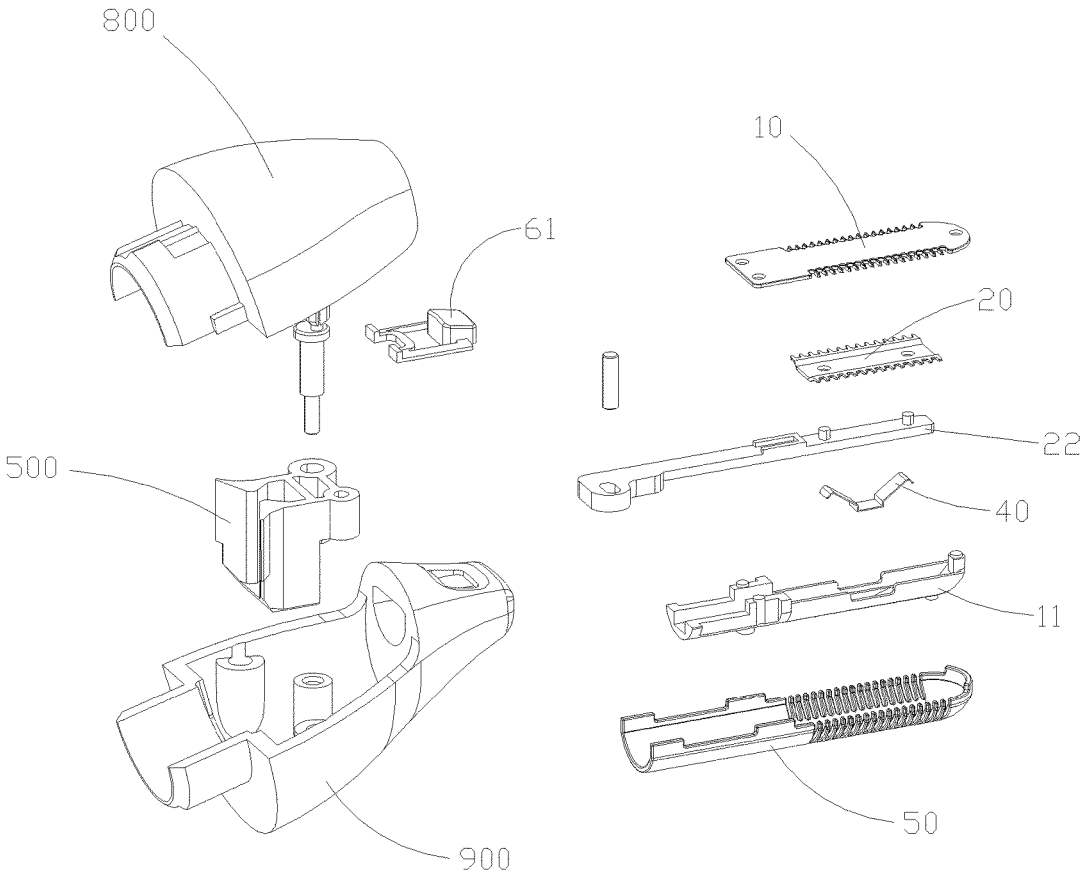
FIG. 8 is a breakdown structure diagram of a scissors head in the Embodiment 2.
Figure 9:
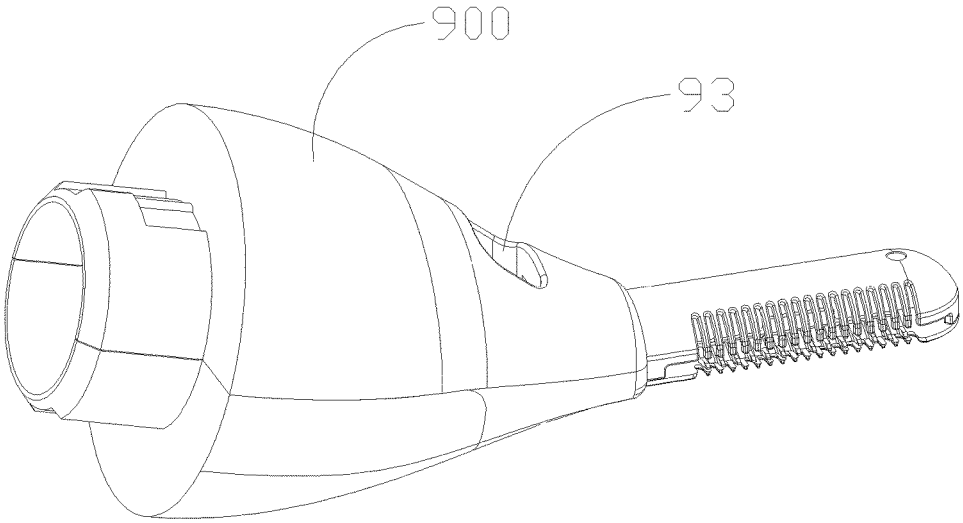
FIG. 9 is an overall structure diagram of the scissors head in the Embodiment 2.
Figure 10:
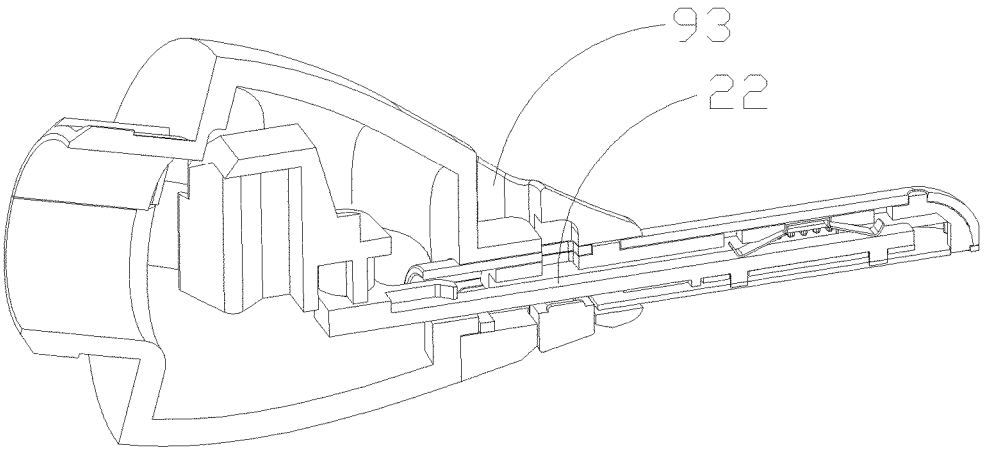
FIG. 10 is a section view of the scissors head in the Embodiment 2.

The pair of vibrissa and eyebrow scissors in this embodiment includes a fixed blade assembly and a moveable blade assembly, and, as shown in FIG. 5 to FIG. 10, the fixed blade assembly includes a fixed blade 10 and a fixed blade carrier 11, the moveable blade assembly comprises a moveable blade 20 and a moveable blade carrier 22. The moveable blade 20 is mounted on one end of the moveable blade carrier 22, the other end of the moveable blade carrier 22 is connected with the driving device (swing frame 500) inside the scissors body, the fixed blade 10 is arranged on the front surface of the moveable blade 20, a blade pressing sheet 40 is arranged between the back surface of the moveable blade carrier 22 and the fixed blade carrier 11, the blade pressing sheet 40 is arranged to tightly press the moveable blade 20 and the moveable blade carrier 22 towards the fixed blade 10, the fixed blade carrier 11 accommodates both the moveable blade assembly and the blade pressing sheet 40, edges of the fixed blade 10 and the fixed blade carrier 11 are fixed together, and a fixed blade cover 50 is arranged on the back surface of the fixed blade cover 11.

The blade separation device of this embodiment is arranged at a position on the front surface of the moveable blade carrier 22 near the rear end part of the moveable blade 20. The blade separation device is composed of a press device 61 and a pivot part 62 connected to one end of the press device 61 far away from the moveable blade 20, the press device 61 is exposed to the upper shell 800 of the scissors head, and the pivot part 62 is sheltered by the upper shell 800 so that the press device 61 will not fall off.

When not pressed, the blade separation device is suspended relative to the moveable blade carrier 22; when the press device 61 is pressed, the blade separation device contacts the surface of the moveable blade carrier 22 and presses the moveable blade carrier 22 together with the moveable blade 20 downwards, meanwhile, the pivot part 62 is pressed by the upper shell 800, the blade pressing sheet 40 is further pressed so that the moveable blade 20 is separated from the fixed blade 10.

In order to realize rinsing after the fixed blade 10 is separated from the moveable blade 20, the bottom shell 900 of the scissors head is provided with a through hole 93, and the through hole 93 is communicated with the bottom surface of the moveable blade 20 or moveable blade carrier, that is, one surface away from the fixed blade 10, to make water passed through.

It should be noted that, for the ordinary staff in this field, various deformations and improvements may be made without departing from the idea of the disclosure, and these deformations and improvements should fall into the scope of protection of the disclosure. Therefore, the scope of protection of the disclosure should be based on claims appended herein.

What is claimed is:

1. A pair of vibrissa and eyebrow scissors having a fixed blade and a moveable blade capable of being rinsed separately, comprising a scissors head and a scissors body, wherein a driving device is arranged in the scissors body, the scissors head comprises a rear end part to be connected with the scissors body and a thin-long end part acting as a cutting part, the thin-long end part comprises a moveable blade and a fixed blade that are arranged in a laminating manner, cutter teeth are formed at one side edge of the fixed blade and at one side edge of the moveable cutter, or are arranged at the two opposite side edges of the fixed blade and the moveable blade, and the moveable blade is driven by the driving device to make a back and forth translation type reciprocating motion relative to the fixed blade to realize the effect of cutting; the pair of vibrissa and eyebrow scissors being characterized in that: the scissors head further comprises a blade separation device, which is connected with the fixed blade or the moveable blade, and, by operating the blade separation device, the fixed blade and the moveable blade that are in a laminating state are separated from each other;

the scissors head is provided with a shell, and the shell is composed of an upper shell and a bottom shell; and the pair of vibrissa and eyebrow scissors comprises a blade pressing sheet, which is arranged on the back surface of the moveable blade and is used to tightly press the moveable blade towards the fixed blade on the back surface of the moveable blade; the blade separation device has such as an elasticity that the amplitude of the fixed blade pried up by the blade separation device not only can offset the height of the moveable blade bounced up by the blade pressing sheet arranged on the back surface of the moveable blade inside the scissors head when the fixed blade no longer presses the moveable blade, but also can make the end part of the fixed blade separated from the moveable blade bounced up by the blade pressing sheet.

2. The pair of vibrissa and eyebrow scissors according to claim 1, characterized in that: the blade separation device comprises a fixed blade carrier acting as a fixed blade fixing device and an elastic element, the fixed blade carrier and the fixed blade are in rigid connection or are integrally molded, the elastic element is arranged between the bottom part of one end of the fixed blade carrier far away from the fixed blade and the shell body, and, by pressing downwards the end part of the fixed blade carrier far away from the fixed blade, the fixed blade is pried away from the moveable blade.

3. The pair of vibrissa and eyebrow scissors according to claim 2, characterized in that: the elastic element is embedded into the upper shell of the scissors head.

4. The pair of vibrissa and eyebrow scissors according to claim 2, characterized in that: the fixed blade carrier is embedded into the surface of the upper shell.

5. The pair of vibrissa and eyebrow scissors according to claim 2, characterized in that: the elastic element is a spring, the upper shell of the scissors head is provided with a groove, one end of the spring abuts against the bottom part of one end of the fixed blade carrier far away from the fixed blade, while the other end abuts against the bottom part of the groove.

6. The pair of vibrissa and eyebrow scissors according to claim 1, characterized in that: the blade separation device is arranged at a position inside the scissors head shell body capable of pressing downwards the rear end part of the moveable blade, and the blade separation device is exposed to the surface of the scissors head upper shell, so that the moveable blade may be pressed towards the direction far away from the fixed blade by pressing the blade separation device, thereby making the moveable blade separated from the fixed blade.

7. The pair of vibrissa and eyebrow scissors according to claim 6, characterized in that: the scissors head comprises a moveable blade assembly, the moveable blade assembly comprises a moveable blade carrier and a moveable blade, the moveable blade is mounted on one end of the moveable blade carrier, the other end of the moveable blade carrier is connected with the driving device, the blade separation device is arranged between a position on the moveable blade carrier near the tail end of the moveable blade and the upper shell of the scissors head; when not pressed, the blade separation device is suspended relative to the moveable blade carrier; when pressed, the blade separation device contacts the surface of the moveable blade carrier and presses the moveable blade carrier together with the moveable blade towards the scissors head internal direction far away from the fixed blade so as to make the moveable blade separated from the fixed blade.

8. The pair of vibrissa and eyebrow scissors according to claim 7, characterized in that: the bottom shell of the scissors head is provided with a through hole, and the through hole is communicated with the bottom surface of the moveable blade or moveable blade carrier, that is, one surface away from the fixed blade, to make water passed through.

* * * * *